106-18.14 5R

XR 3,936,267
12006R

United Stat

Wasley et al.

[11] 3,936,267

[45] Feb. 3, 1976

[54] FLAMEPROOFING WOOL TEXTILES

[75] Inventors: William L. Wasley, Berkeley; Allen G. Pittman, El Cerrito, both of Calif.

[73] Assignee: The United States of America as represented by the Secretary of Agriculture, Washington, D.C.

[22] Filed: Feb. 27, 1975

[21] Appl. No.: 554,055

[52] U.S. Cl. ..... 8/128 R; 106/15 FP; 428/570

[51] Int. Cl.[2] ..... D06M 3/02

[58] Field of Search ..... 8/128, 131; 260/551 P; 106/15 FP; 428/270

[56] References Cited

UNITED STATES PATENTS

| | | | |
|---|---|---|---|
| 2,660,543 | 11/1953 | Walter | 260/551 P |
| 2,714,051 | 7/1955 | Barnes | 8/128 R |
| 3,666,401 | 5/1972 | Cahill | 106/15 FP |
| 3,666,402 | 5/1972 | Meyers et al. | 106/15 FP |
| 3,698,854 | 10/1972 | Donaldson | 8/116 P |
| 3,715,185 | 2/1973 | Meyers | 8/194 |

*Primary Examiner*—Theodore Morris
*Attorney, Agent, or Firm*—M. Howard Silverstein; William Takacs; Max D. Hensley

[57] ABSTRACT

The flame resistance of wool textiles is increased by sequential application of N,N′,N″-triallylphosphoramide and bromine.

5 Claims, No Drawings

3936267
08 IN 8/128R

FLAMEPROOFING WOOL TEXTILES

DESCRIPTION OF THE INVENTION

This invention relates to and has among its objects the provision of novel modified wool products which are particularly characterized by flame resistance. The objects of the invention also include novel methods for preparing these modified wool products. Further objects of the invention will be evident from the following description wherein parts and percentages are by weight unless otherwise specified.

Although wool does not ignite readily, flames will propagate in wool once ignition has occurred. A need, therefore, exists to flameproof wool for many uses such as airplane upholstery, carpeting blankets, sleepwear, and the like. A particular aim of the invention is to fulfill this need.

We have discovered that wool textiles can be flameproofed by sequential treatment with N,N′,N″-triallylphosphoramide and bromine.

The primary advantage of the invention is that the modified wool will not ignite nor will it support combustion. When exposed to a flame, the modified wool will only be charred. When the flame is then removed, the modified wool will not continue to burn. This feature of wool treated in accordance with the invention is in sharp contrast to that of untreated wool, which will continue to burn even after the flame source is removed.

Another valuable asset of the invention is that the modification does not impair the intrinsic properties of the wool. For example, the treatment does not impair the elasticity, hand, or tensile strength of the textile. The products of the invention are suitable for all the conventional uses of wool, such as fabrication of carpeting, upholstery, and drapery fabrics, garments, etc.

N,N′,N″-Triallylphosphoramide (which may also be named N,N′,N″-triallylphosphoric triamide) is a known compound of the formula $$(CH_2=CH-CH_2-NH)_3P=O$$

The synthesis thereof is disclosed, for example, by Meyers et al., U.S. Pat. No. 3,715,185. For the sake of brevity, the compound will hereinafter be referred to as NTP.

Meyers et al. disclose the use of NTP for flameproofing cotton and other cellulosic textiles. It should be noted, however, that the patentees do not disclose or suggest the use of bromine in conjunction with NTP. Furthermore, as will be shown herein, the flame-resistance obtained in accordance with the instant invention is far superior to that obtained by Meyers et al.

In preparing flame-resistant wool in accordance with the invention, the following procedure is used: An aqueous solution of NTP is prepared. The amount of NTP in the solution is generally about 5–15%; the preferred concentration of NTP is about 8–10%. Next, the wool to be treated is impregnated with the NTP solution. Impregnation is most easily effectuated by immersing the wool in a bath of the NTP solution. Alternatively, the treating solution can be applied to the fabric by spraying, rolling, padding, or other technique as known to those skilled in the art. Following the application of the solution so as to impregnate the textile material, the excess of the solution can be removed by squeezing, centrifugation, pressing, or similar operations. In any event the impregnation is conducted under such conditions that the amount of NTP deposited on the textile is about 4 to 10%, based on the weight of the textile.

The so-treated wool is then dried. Generally, the wool can be dried at room temperature for about 24 hours. However, drying can also be accomplished at elevated temperatures for a shorter period of time.

In the next step the textile is treated with elemental bromime in order to obtain a reaction thereof with the previously-applied NTP. To this end, a solution of bromine in an inert volatile solvent—typically, a halogenated hydrocarbon such as carbon tetrachloride, chloroform, tetrachloroethylene, ethylene dichloride, or the like—is prepared and applied to the textile. Generally, a dilute solution is used, that is, one containing about 0.1 to 1% bromine, and enough of the solution is applied to provide about from 1 to 3 parts of bromine per part of NTP on the textile. The bromine solution can be applied to the textile by dipping, spraying, rolling, or like techniques. In a preferred modification of the invention, the textile is immersed in the bromine solution for a period of 1–2 hours, whereby each part of NTP on the textile reacts with about from 0.5 to 1 part of bromine.

After application of the bromine the treated fabric is subjected to squeezing, centrifuging, pressing, or other similar operation to remove excess bromine solution. The so-modified wool is then dried as described above, i.e., at ambient temperature for about 24 hours or at elevated temperature for a shorter period of time.

It should be noted that the benefits of the invention are attained only when the wool is first treated with NTP and then with bromine. If the steps are reversed, no flameproofing is realized. In addition, the above treatment must be carried out in situ, i.e., on the fabric. If NTP is first reacted with bromine and the resulting product is applied to the fabric, the treatment is essentially ineffective.

The invention has extensive utility and can be applied to all-wool textiles and to textiles which contain at least 25% wool, typically, blends of wool with other natural or synthetic fibers such as cotton, linen, hemp, jute, ramie, sisal, cellulose acetate, cellulose acetate-butyrate, saponified acetate rayons, viscose rayons, cuprammonium rayons, ethyl cellulose, animal hair, polyurethane, polyacrylonitrile, polyesters such as polyethylene terephthalate, and the like. The term "wool-containing textile" is used herein as inclusive of all-wool textiles and wool blends which contain at least 25% wool. The textile material to which the invention is applied may be in the form of bulk fibers, yarns, sliver, roving, top, webbing, card, tape, woven or knitted fabrics, garments, or garment parts.

EXAMPLES

The invention is further demonstrated by the following illustrative examples.

The flame tests reported in the examples were carried out by the AATCC vertical flame test method 34–1969.

EXAMPLE 1

Run A (Sequential treatment with NTP and bromine): A 20-gram piece of 100% wool plain-weave fabric was impregnated with an 8% aqueous solution of NTP. The so-treated fabric was padded through a squeeze roll and had a wet uptake of 50%, which corresponded to a 4% add-on of NTP. Then, the fabric was air-dried at ambient temperature for 24 hours.

A 12-gram piece of the above fabric was soaked for 1 hour in 500 ml. of carbon tetrachloride containing 1.3 g. of bromine. At the end of this time the woolen fabric was squeezed and then allowed to air-dry overnight. The treated fabric had excellent hand and color. Xray fluorescence analysis for bromine and phosphorus indicated that the treated fabric contained 1.78% bromine and 0.55% phosphorus. The so-treated fabric was then subjected to the flame test.

For purpose of comparison, four other fabrics were also tested for flame resistance. In Runs B and C, samples of the wool fabric were treated with NTP alone (according to Meyers et al., U.S. Pat. No. 3,715,185) so that the add-on of NTP was 4% and 10%, respectively. In Run D, a pre-formed reaction product of NTP and bromine was applied to the wool fabric. To this end, 21.5 g. (0.1 mole) of NTP was dissolved in 250 ml. of carbon tetrachloride in a 3-neck flask equipped with a stirrer, condenser with drying tube, and a dropping funnel. A solution of 16 g. (0.1 mole) of bromine in carbon tetrachloride was added through the dropping funnel. The bromine solution was added slowly, over a period of 2 hours, while the reaction mixture was stirred and cooled with an ice bath. After addition of the bromine solution, the reaction mixture was allowed to stand at room temperature overnight. Then the carbon tetrachloride was evaporated, leaving 37 g. of the NTP-bromine reaction product. A portion of this reaction product was dissolved in carbon tetrachloride and the wool fabric impregnated therewith, then passed through squeeze rolls and dried in air. The add-on of NTP-bromine reaction product was 10.9%.

Finally (Run E) a sample of the untreated wool fabric was subjected to the flame test.

The results of are tabulated below.

Table 1

| Run | Fabric treatment | Add-on, % | After flame, sec. | Char length, inches |
|---|---|---|---|---|
| A | Sequential application NTP and bromine | 4.0 | 0 | 3.9 |
| B | NTP, alone | 4.0 | 10 | 8.2 |
| C | NTP, alone | 10.0 | 2.7 | 4.8 |
| D | Pre-formed NTP-$Br_2$ reaction product | 10.9 | 19 | BEL* |
| E | None | 0 | 26 | BEL* |

*Burned entire length (10 in.)

EXAMPLE 2

The procedure outlined in Example 1 was applied to a woven fabric composed of 60% wool and 40% polyester.

The results are summarized below.

Table 2

| Run | Fabric treatment | Add-on, % | After flame, sec. | Char length, inches |
|---|---|---|---|---|
| F | Sequential application of NTP and bromine | 6.1 | 0 | 5.0 |
| G | NTP, alone | 6.2 | 18 | BEL |
| H | Pre-formed NTP-$Br_2$ reaction product | 6.5 | 19 | BEL |
| I | None | 0 | 27 | BEL |

EXAMPLE 3

The procedure outlined in Example 1 was applied to a woven fabric composed of 50% wool and 50% cotton.

The results are summarized below.

Table 3

| Run | Fabric treatment | Add-on, % | After flame, sec. | Char length, inches |
|---|---|---|---|---|
| J | Sequential application of NTP and bromine | 5.0 | 0 | 5.6 |
| K | NTP, alone | 5.6 | — | BEL |
| L | None | 0 | 4.7[a] | BEL |

[a]Fabric was completely charred; the ash glowed for 4.7 sec.

Having thus described our invention, we claim:

1. As an article of manufacture, a woolen-containing textile carrying a deposit of N,N′,N″-triallylphosphoramide which has been reacted in situ on the textile with bromine, and wherein the amounts of N,N′,N″-triallylphosphoramide and bromine are sufficient to render the textile flame resistant.

2. As an article of manufacture, a wool-containing textile carrying a deposit of N,N′,N″-triallylphosphoramide which has been reacted in situ on the textile with bromine, and wherein the amount of N,N′,N″-triallylphosphoramide is about from 4 to 10% based on the weight of the textile and the amount of the bromine is about from 0.5 to 1 part per part of N,N′,N″-triallylphosphoramide on the textile.

3. A process for modifying a wool-containing textile to make it flame resistant, which comprises a. applying N,N′,N″-traillylphosphoramide to the textile, and b. then applying bromine to the so-treated textile.

4. The process of claim 3 wherein the amounts of applied N,N′,N″-triallylphosphoramide and bromine are sufficient to render the textile flame resistant.

5. A process for modifying a wool-containing textile to make it flame resistant, which comprises a. contacting the textile with an aqueous solution of N,N′,N″-triallylphosphoramide to deposit on the textile about from 4 to 10%, based on the weight of the textile, of said compound, b. drying the textile, c. contacting the textile with a solution of bromine in an inert volatile solvent until the textile has absorbed about from 0.5 to 1 part of bromine per part of N,N′,N″-triallylphosphoramide on the textile, and d. drying the so-treated textile.

* * * * *